United States Patent [19]

Weinar

[11] 4,194,336

[45] Mar. 25, 1980

[54] CONCEALABLE RETAINING CLIP FOR WALLBOARDS

[76] Inventor: Roger N. Weinar, 168 W. Woodside Ave., Buffalo, N.Y. 14220

[21] Appl. No.: 853,046

[22] Filed: Nov. 21, 1977

[51] Int. Cl.[2] ..... E04B 5/52

[52] U.S. Cl. ..... 52/481; 52/489; 52/735; 52/714; 52/509

[58] Field of Search ..... 52/712–715, 52/482, 483, 484, 489, 502, 509, 735, 354, 357, 481, DIG. 6; 85/11, 14, 16

[56] References Cited

U.S. PATENT DOCUMENTS

| | | | |
|---|---|---|---|
| 1,312,056 | 8/1919 | Shaw | 85/11 |
| 1,373,036 | 3/1921 | Upson | 85/14 |
| 1,612,993 | 1/1927 | Strand | 52/354 |
| 1,826,133 | 10/1931 | Hatch | 52/468 |
| 1,879,457 | 9/1932 | Paulsen | 52/714 |
| 1,984,028 | 12/1934 | Macleod | 52/484 |
| 1,997,092 | 4/1935 | Duffy | 52/502 |
| 1,998,688 | 4/1935 | Robinson et al. | 52/481 |
| 2,326,506 | 8/1943 | Tummins | 85/14 |
| 3,730,466 | 5/1973 | Swanquist | 52/714 |
| 3,844,085 | 10/1974 | Marchello | 52/735 |
| 4,000,596 | 1/1977 | Magill et al. | 52/481 |

FOREIGN PATENT DOCUMENTS

| | | | |
|---|---|---|---|
| 551261 | 10/1956 | Belgium | 52/481 |
| 58176 | 6/1939 | Denmark | 52/DIG. 6 |

*Primary Examiner*—James L. Ridgill, Jr.
*Attorney, Agent, or Firm*—Raymond F. Kramer

[57] ABSTRACT

The present invention relates to a system for the demountable attachment of architectural components and particularly the demountable attachment of wallboard panels to conventional wall and partition framing members, in such a way as to permit individual panels to be removed for access to the wall cavity. A preferred form of the invention utilizes a series of barbed clips, mechanically fastened to conventional framing members along each panel intersection joint. The clips are provided with a series of resilient barbs, protruding in angular opposing directions so as to penetrate and engage opposing marginal edges of abutting wallboard panels. The clip barbs spear wallboard panel edges in a pawl-like manner to permit the wallboard panels to be urged inward to the framing member surface, there retained by the natural outward obstruction of the hinged barbs. A desirable form of the clip has the barbs located in close proximity to the clip edge to permit controlled fracture and separation of the barbs when the panels are urged outward with a determined force, thus permitting individual panels to be removed without damage. The wallboard panel may be reinstalled or a new wallboard panel may be installed when the broken clips are replaced with new ones.

11 Claims, 15 Drawing Figures

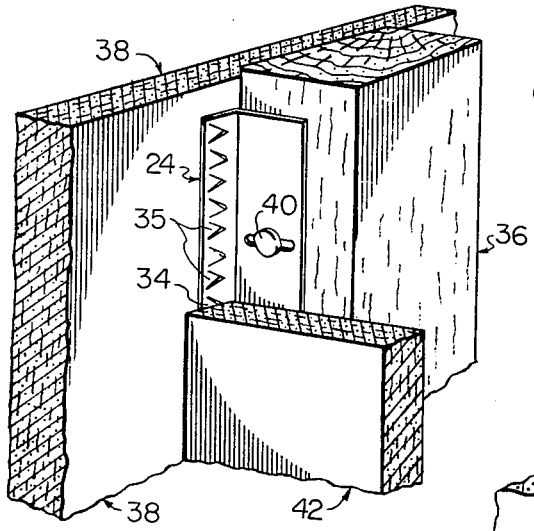
Fig. 5
Fig. 6
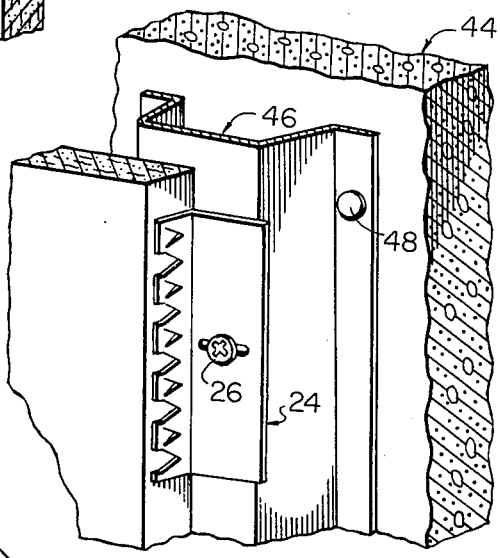
Fig. 8
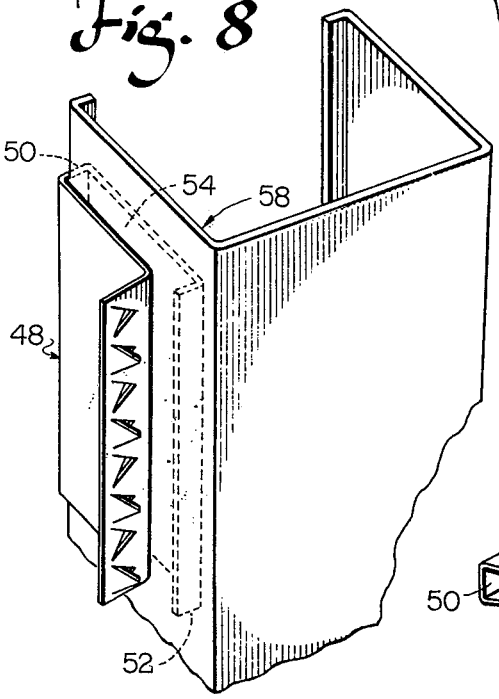
Fig. 7
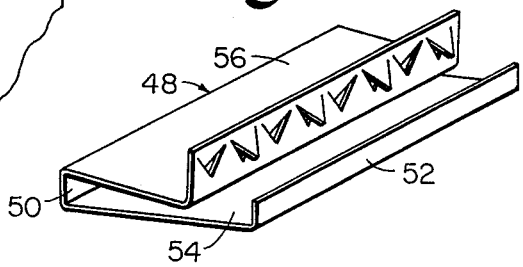

CONCEALABLE RETAINING CLIP FOR WALLBOARDS

DESCRIPTION OF THE PRIOR ART

Numerous systems have been proposed for connecting wallboard panels to wood or fireproof metal framing members, the more desirable methods provide individual panel removal for accessibility to the wall cavity. This single panel accessibility is particularly useful in commercial buildings where inner wall services, such as electric, water, gas, etc., must be accessible for alterations necessitated by frequent changes in occupant requirements. Maintenance is also simplified when damaged panels may be replaced individually. To achieve this accessibility, common practice is to secure the panels directly to the studs or framing with screw fasteners, which then must be concealed with decorative battens. More recently securing mechanisms have been devised to invisibly secure the panels to framing members and eliminate the unsightly exposed fasteners and battens. It has been proposed to use clip structures wherein hooks are appended to the wallboard panels and receiving slots are provided on the framing members. See for example, U.S. Pat. No. 3,550,338 issued Dec. 29, 1970 to D. M. Satkin et al. The obvious disadvantage of the Satkin system is the necessity for specially perforated framing members. Another proposal has panel appended tabs and a receiver configuration, mechanically secured to the framing members. See U.S. Pat. No. 3,759,001, T. E. Judkins, et al., issued Sept. 18, 1973. Here again a special framing member (box section) is necessary. Different receiver configurations would have to be provided for use on standard channel studs or common furring runners. Both the Satkin and the Judkins systems are dependent on accurate center to center spacing of the framing members and common accumulated panel width error cannot be tolerated.

While these panel attachments do provide individual panel removal, the search continues for an individually removable panel attachment comprised of a single fastener clip universally attachable to all common framing members, such as wood or metal studs, "C" shaped channel furring, "Z" shaped furring runners, etc., whereby the installer has the option to adjust the fastener location with respect to the framing member center location to compensate for the accumulated dimensional error inherent in normal wallboard panel construction.

The above patents include, in my opinion, the closest prior art of which I am aware, but must not be construed as a representation that no better art exists or that a complete search has been made.

SUMMARY OF THE INVENTION

It is the primary purpose of the instant invention, therefore, to provide an improved system for securing wallboard panels to conventional wood and metal framing members in such a manner as to permit individual panels to be removed and replaced without damage. More specifically, there is provided a wall or partition assembly incorporating therein spaced apart framing members, having substantially flat surface portions, rows of adjacent wallboard panels, having substantially square vertical edges, each pair of adjacent edges defining a joint with a framing member positioned in the vicinity of each joint, and a means of securing the wallboard panels to the framing members. The improvement features fastening clips, each having a plurality of resilient barbs, protruding angularly inward in opposing directions so as to penetrate and engage opposing vertical edges of abutting wallboard panels invisibly within each panel joint. The hinged barbs are partially stamped-out, near the edge of the clip to allow the barbs to fracture and separate from the clip portion to permit individual panels to be removed without damage. New clips are then required for panel replacement.

All wallboard clips contemplated by the present invention will include the series of resilient barbs, but the barbs may differ in shape and angle to meet specific requirements of various compositions of wallboard panels. Also, within the scope of the invention, numerous types of clip securing devices may be designed or employed to accommodate specific framing member configurations, but in every instance, the clip will include the series of resilient barbs.

BRIEF DESCRIPTION OF DRAWINGS

Further features, objects and advantages will be evident from the following detailed description of the preferred embodiments of the present invention taken in conjunction with the accompanying drawings, in which:

FIG. 5 is a fragmentary perspective view of a wood stud inside corner construction, parts of which have been broken away to illustrate an alternate use of the retaining clip configuration of FIG. 2;

FIG. 6 is a fragmentary perspective view of a typical metal furred masonry wall, illustrating how the retaining clip of FIG. 2 fractures to permit the removal of individual wallboard panels;

FIG. 7 is a perspective view illustrating an alternate embodiment of the invention for use on common channel framing members, the body portion of the clip is extended and constructed to engage a "C" channel stud member without the auxiliary screw or nail fastener;

FIG. 8 is a fragmentary perspective view of a typical metal "C" stud member in cooperation with an installed retaining clip of the configuration illustrated in FIG. 7;

DESCRIPTION OF THE PREFERRED EMBODIMENTS

Figure 1:
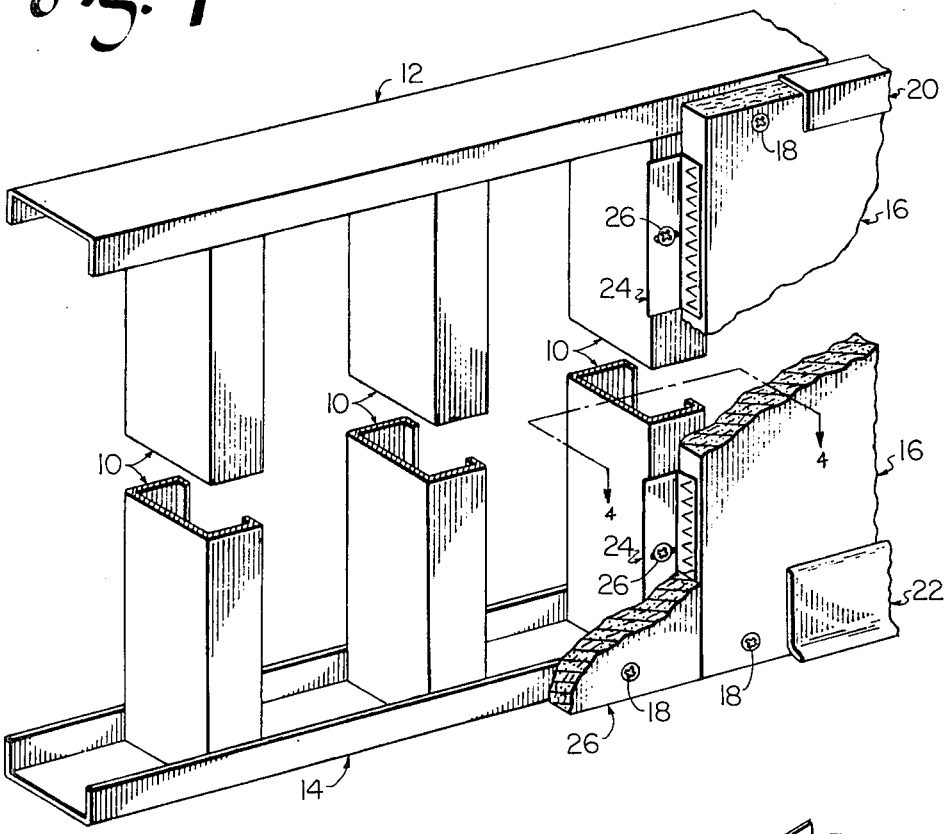
FIG. 1 is a fragmentary perspective view of a typical metal stud wall assembly, parts of which have been broken away to expose the cooperating interior components, and to illustrate how a preferred embodiment of the instant invention may be used.

Referring more specifically to the drawings, for illustrative purposes, the invention is shown in FIG. 1 as being installed on a typical metal stud wall structure or partition in accordance with the invention. The wall structure or partition comprised laterally spaced metal "C" studs 10, which have their upper and lower ends retained in rigid channel shaped upper ceiling, and lower floor tracks 12 and 14. These tracks are also formed of metal and may be removably mounted on the ceiling and floor with the open sides of the channel tracks in confronting relationship to receive the respective ends of the studs. The studs 10 are cut to appropriate length and manipulated into the desired position, extending between the ceiling and floor. Wallboard panel 16 is positioned against the framing and adjusted to cause the panel edges (joints) to fall on approximate centers of the vertical studs 10. The panel is then mechanically secured to the upper ceiling and the lower floor tracks with suitable sheet metal screw fasteners 18. On sheet metal framing members, as illustrated in FIG. 1, this procedure is often accomplished with an electric powered screw driver and self-drilling, self-tapping screws. On wood framing screws or nails could be used. Ceiling trim batten 20 and floor trim base 22 are installed on the completed wall to conceal these fasteners. After each panel has been positioned and secured to the ceiling and floor tracks, barbed retainer clips 24 are positioned in the inside corner formed by the wallboard panel 16 and the stud 10 and secured by a suitable mechanical fastener such as a sheet metal screw 26. These screws 26 have a low-profile head designed to crush into the wallboard panel back surface as best illustrated in FIG. 4. Referring again to FIG. 1, the next wallboard panel 26 is erected in an edge abutting position and secured to the ceiling track 12 and the floor track 14 as described. Each retaining clip 24 is provided with an elongated slot 28, FIG. 2, which allows slight lateral movement when the wallboard panels are abutted. This self-locating feature will compensate for slight variances in the center to center location common in all framing construction. The retainer clips 24 are now concealed within the tightly abutting joint of the wallboard panels but the wallboard panels will not necessarily be flush against the studs or flush to each other, so the panels must be urged inward along the joints, permitted by the inward-only inclination of the barbs, best illustrated in FIGS. 2–4. In the case of very dense wallboard, such as common paper wrapped gypsum drywall panels, a flat wooden block may be placed across the joint and struck with a hammer to force the panels inward. The outward deflection of the panels along the joints is obstructed by the tendency of the barbs to penetrate the wallboard edges as best illustrated in FIG. 4. The above procedures are then repeated for the entire length of the wall.

Figure 2:
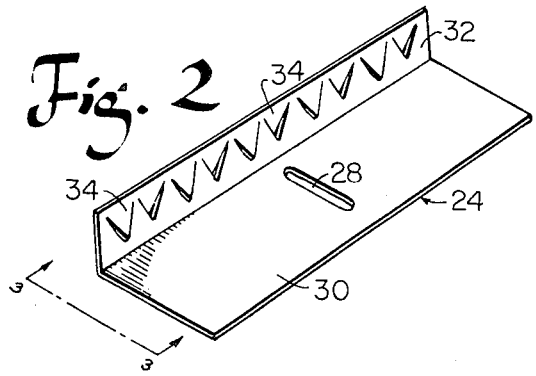
FIG. 2 is a perspective view of the retaining clip shown in FIG. 1.
Figure 3:
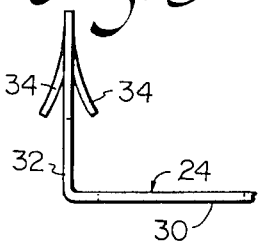
FIG. 3 is an enlarged partial end elevation of the clip of FIG. 2 taken in the direction indicated in FIG. 2.
Figure 4:
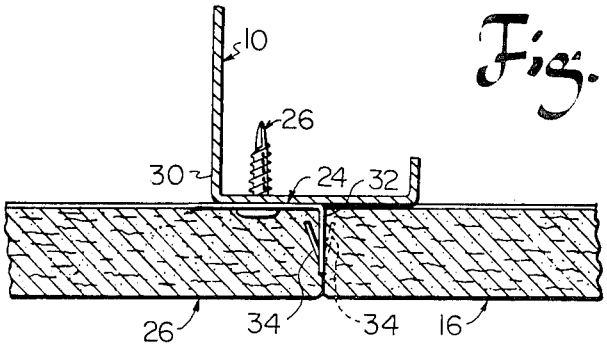
FIG. 4 is a sectional view taken along line 4—4 of FIG. 1.

Referring to FIGS. 2 and 3, and to the retainer clip 24 in more detail, it may be seen that the retainer clip 24 is formed of a single sheet of metal, comprising a flat rectangular plate portion 30 with an elongated fastener aperture or slot 28, an elongated barb carrier portion 32, extending perpendiculary upward from the plate portion 30, the carrier portion 32 having a series of substantially "V" shaped barbs 34 angularly struck in alternately opposing outward directions, pointed downward toward the plate portion. While the exact design and dimensions of the retainer clip may vary considerably to accommodate different wallboard panel compositions, it has been found that standard gypsum wallboard panels $\frac{1}{2}$ to $\frac{3}{4}$ of an inch in thickness may be used with a retainer clip formed of 26 gauge spring steel, with the plate portion approximately three inches long by one inch wide, with the barb carrier portion approximately $\frac{3}{8}$ of one inch high, extending for the entire length of the plate to allow the placement of ten $\frac{1}{4}$ inch barbs (five in each direction). A series of five of these clips spaced about 16 inches on center, is sufficient to secure a standard eight foot high gypsum wallboard panel, which weighs about forty pounds. The barbs themselves may also be constructed to suit a particular wallboard composition. For example, the barbs may be blunted to a radius to prohibit excessive wallboard edge puncture. In the case of standard paper wrapped gypsum wallboards, as manufactured in the United States, a radius of approximately 5/64 of an inch is desirable, while standard gypsum wallboards as commonly used in Europe may operate best with a radius of $\frac{1}{8}$ of an inch or more, because of the lower density of the European materials. The outward deflection angle of the barbs and the formed shape of the barbs may also be varied to suit the composition of the wallboard covering. A flat barb operates best with low density material, a barb deflected on a radius works better on harder materials and a barb formed outwardly on a cycloidal curve provides the best retention of the heavily embossed vinyl surfaced gypsum drywall panels commonly used in commercial construction.

Referring now to FIG. 5, a typical inside corner assembly, commonly found in partition construction, is used to show how the retainer clip 24 is also used on common wood framing members, such as wood stud 36. In this assembly, wood stud 36 would be secured to preinstalled wall 38 with suitable fasteners, and spaced retainer clips 24 are then positioned and by nail 40 to the stud 36 at suitable intervals. Abutting wallboard panel 42 may then be urged into the corner and retained by the inwardly directed barbs 34 of the retaining clip 24. It should be noted that the outwardly directed barbs 35 penetrate wall 38 surface and prevents movement of the abutting wall assembly at the corner joint.

Referring now to FIG. 6, a masonry wall 44 has been furred out with a common channel shaped metal runner 46, secured in place by suitable fasteners 48, such as tempered nails. Again, the retainer clip 24 is secured to the metal furring channel 46 with self-drilling, self tapping sheet metal screw 26. In this illustration it is assumed that the wall assembly had been preconstructed and a wallboard panel (not shown) has been removed to illustrate the destructable feature of the retainer clip 24. When the removed panel (not shown) was urged outward with a determined force, it caused the inwardly directed barbs (not shown) to fracture and separate from the retainer clip 24. A new retainer clip may now be substituted for the destroyed clip and the wallboard panel may be reinstalled.

The versatility of the retainer clip 24 (FIG. 2) becomes more apparent from FIGS. 1, 5 and 6, in which three different framing members, metal stud 10, wood stud 36 and metal furring 46 all use such same retainer clip. It is easy to see that retainer clips of this configuration could be used on any flat surfaced framing members, such as: wood furring, "Z" metal furring, box beam studs, etc.

Referring now to FIG. 7 and FIG. 8, a modified form of retainer clip 48 is illustrated. In this embodiment, the plate portion 56 has been extended to a channel configuration comprised of a pair of web portions 50 and 52, connected by a flange portion 54. It may be seen that the plate portion 56 is in an angular converging relation to the flange portion 54 to provide additional spring tension for the clip 48 when installed on a common sheet metal channel stud 58 as illustrated in FIG. 8. While substantially more material is required to form a retainer clip of this configuration, the additional cost may be justified, since the need for the auxiliary screw fastener is eliminated.

Figure 9:
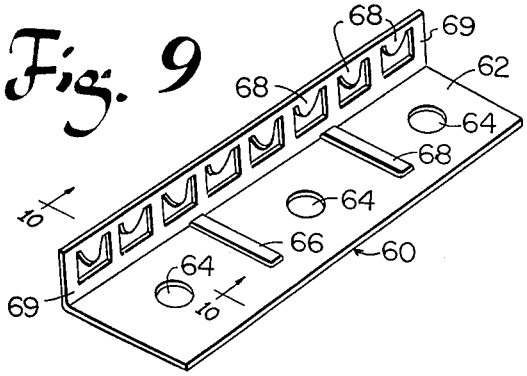
FIG. 9 is a perspective view similar to FIG. 2 but illustrating an alternate embodiment of the invention where material is punched-out and removed around each barb.
Figure 10:
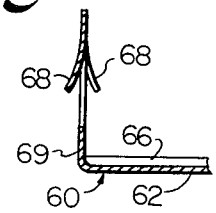
FIG. 10 is a sectional veiw taken along line 10—10 of FIG. 9.

Referring to FIG. 9 a modified form of a retainer clip 60 is illustrated comprising a plate portion 62, with a series of round fastener holes 64 and a pair of stiffening ribs 66 and 68 and an elongate barb carrier portion 69 extending perpendicularly upward from the marginal edge of the plate portion 62 having a series of "U" shaped apertures punched out to define a series of rounded barbs 68, angularly formed in alternately opposing outward directions. The removal of the material around the barbs provides more resiliency and also simplifies the manufacture of the parts.

Figure 11:
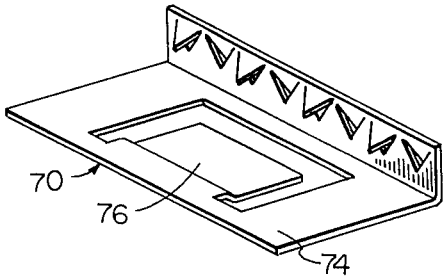
FIG. 11 is a perspective view illustrating an alternate embodiment of the invention for use on common "H" stud framing members in which the body portion of the clip is struck out and formed to engage the "H" stud member without an auxiliary screw or nail fastener.
Figure 12:
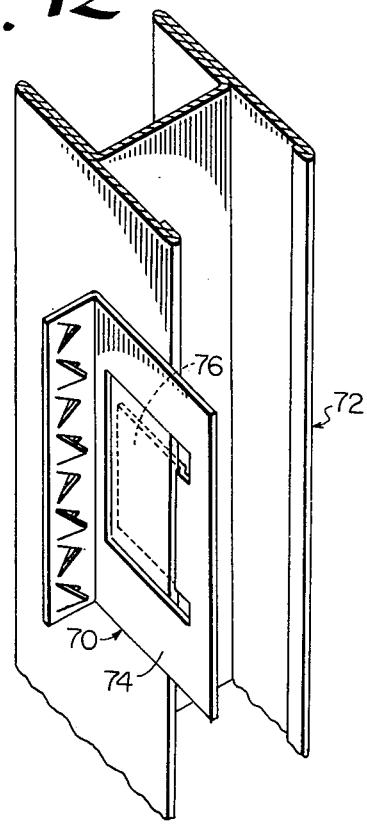
FIG. 12 is a fragmentary perspective view of a typical "H" stud framing member in cooperation with an installed clip of the configuration illustrated in FIG. 11.

Referring now to FIGS. 11 and 12 a barbed retainer clip 70 has been modified for use on the somewhat less common "H" stud 72 framing members. The plate portion 74 of the retaining clip 70 has been widened and stamped out in a "U" shape to define a resilient tab 76 depressed to a lower plane so as to engage the interior flange surface 78 when positioned on the "H" stud 72 as illustrated in FIG. 12.

Figure 13:
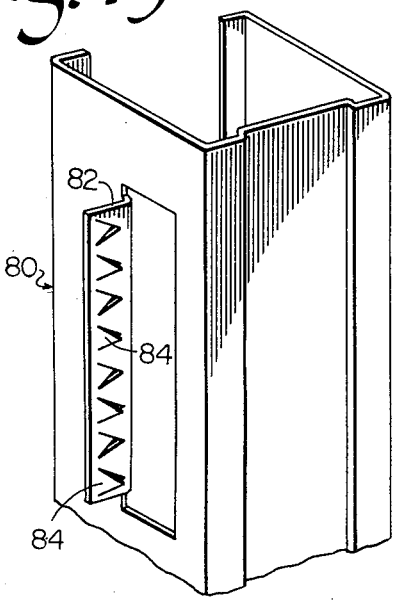
FIG. 13 is a perspective view illustrating an alternate embodiment of the invention in which the barbed retainer is stamped from the surface material of a common metal "C" stud.

Referring to FIG. 13 a common sheet metal stud 80 has an integral barb carrier portion 82. The barbs 84 and the carrier portion 82 are formed as an intregal unit from the stud flange material itself.

Figure 14:
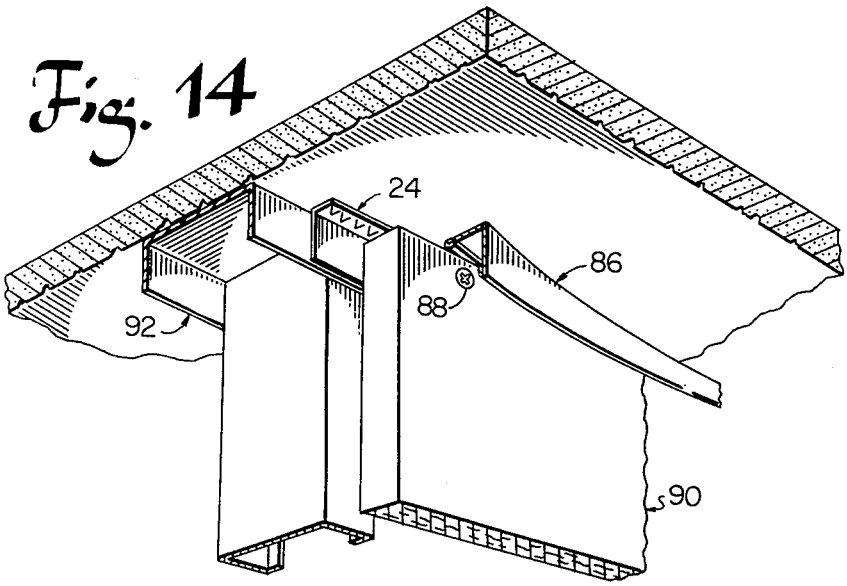
FIG. 14 is a fragmentary perspective view of a partially completed wall and ceiling assembly, illustrating the use of the retainer clip shown in FIG. 2 to secure a wallboard panel trim member.

Referring now to FIG. 14 the retainer clip 24 illustrated in FIG. 2 is shown used to retain an "L" shaped ceiling trim member 86. The trim member 86 conceals the screw fasteners 88 which hold the top marginal edge of wallboard panel 90 to the upper channel track 92.

Figure 15:
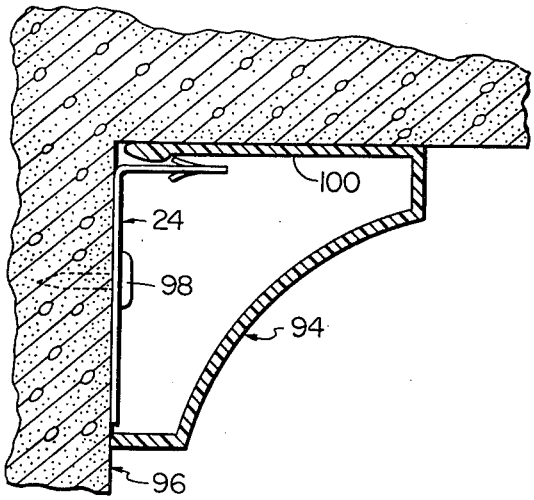
FIG. 15 is a sectional veiw of an inside ceiling corner construction illustrating the use of the retainer clip shown in FIG. 2 to secure a decorative cove member.

Referring now to FIG. 15 which illustrates an inside ceiling corner construction, here the barbed retainer clip 24, as shown in FIG. 2 is used to secure a decorative cove runner section 94. In this application the clip 24 is secured to the existing wall 96 with a suitable fastener 98 and is positioned to receive the extended leg portion 100 of the decorative runner 94. The runner 94 could have any of a number of decorate configurations and could be made of metal or extruded plastic. A solid wood section could also be used if it were slotted to receive the barbs.

While I have shown and described a number of embodiments of the invention, it is obvious that various modifications may be made without departing from the spirit of the invention and hence I do not want to be restricted to the specific forms shown or uses mentioned except to the extend indicated in the appended claims.

What I claim is:

1. A concealable retaining clip for wallboards to hold them to framing members which comprises:

(A) a substantially flat plate portion which is fastenable to a framing member;

(B) a barb carrier portion which is a substantially perpendicular extension of said plate portion; and (C) a plurality of spaced apart barbs carried by the barb carrier portion and having impaling edges thereof directed toward the plane of the plate from said barb carrier portion in alternately opposing outward directions away from the plane of the barb carrier portion so that said barbs may hold adjacent wallboards in position with one such wallboard pressing against the substantially flat plate portion of the retaining clip and the other pressing against a framing member to which said clip is fastenable.

2. A retaining clip according to claim 1, wherein the clip is formed from a single sheet of resilient metal.

3. A retaining clip according to claim 1 wherein the substantially flat plate portion is rectangular, the barb carrier portion is elongated and rectangular and the barbs are integral with the barb carrier portion and are struck from said portion.

4. A retaining clip according to claim 3, wherein the barbs are pointed "V" shaped protrusions.

5. A retaining clip according to claim 3, wherein the

6. A retaining clip according to claim 3 wherein the barbs are flat and extend outwardly in two planes at an angle to each other.

7. A retaining clip according to claim 3 wherein carrier portion material about openings therein made by the striking of the barbs is removed to facilitate deflections of the barbs.

8. A retaining clip according to claim 3, wherein one or more apertures or holes are in the plate portion to facilitate screw or nail fastening of the clip.

9. A retaining clip according to claim 8, wherein the apertures or holes are elongated to permit adjustment of the clip after fastening.

10. A retaining clip according to claim 3 wherein the barbs are curved outwardly in concave curves viewed from a side of the barb carrier portion toward which the impaling edges of the barbs are directed.

11. A retaining clip according to claim 10 wherein the curves of the barbs are portions of circular or cycloidal curves.

* * * * *